US005844581A

United States Patent [19]

DeJoseph et al.

[11] Patent Number: 5,844,581

[45] Date of Patent: Dec. 1, 1998

[54] ELECTRONIC CONTROL FOR CONSISTENT INK JET IMAGES

[75] Inventors: Anthony B. DeJoseph, NY; Phillip C. Jerzak, Grand Island; Anthony V. Moscato, North Tonawanda, all of N.Y.

[73] Assignee: Moore Business Forms Inc., Grand Island, N.Y.

[21] Appl. No.: 654,241

[22] Filed: May 25, 1996

[51] Int. Cl.[6] ..... B41J 2/35

[52] U.S. Cl. ..... 347/14; 347/15; 347/19

[58] Field of Search ..... 347/14, 15, 19, 347/9

[56] References Cited

U.S. PATENT DOCUMENTS

| | | | |
|---|---|---|---|
| 4,463,359 | 7/1984 | Ayata et al. | 347/56 |
| 4,509,057 | 4/1985 | Sohl et al. | 347/19 |
| 5,285,220 | 2/1994 | Suzuki et al. | 347/14 |
| 5,325,112 | 6/1994 | Muto | 347/19 |
| 5,422,662 | 6/1995 | Fukushima et al. | 347/211 |
| 5,473,351 | 12/1995 | Helterline et al. | 347/19 |
| 5,550,638 | 8/1996 | Ikeda et al. | 358/296 |
| 5,682,185 | 10/1997 | Wade et al. | 347/19 |

*Primary Examiner*—Valerie Lund
*Assistant Examiner*—Christina Annick
*Attorney, Agent, or Firm*—Nixon & Vanderhye, P.C.

[57] ABSTRACT

A method and assembly varies the image density of ink from a plurality of ink jet nozzles to provide substantially uniform ink density. Electronically and automatically the electrical power consumption of an ink jet device having an electrical heater is measured (typically by measuring the current draw), and in response to that measurement, if necessary, pulse or voltage supplied to the heater or heaters of each of the ink jet devices is automatically adjusted. More electrical power is supplied if greater image density is required for a particular ink jet device, and less electrical power if lower image density is desired. During typical operation all pulse widths are reset to default settings, the signal received is calibrated, a pattern generator is signalled to provided test data, the present peak electrical current consumed by each nozzle heater is sampled, and the pulse width for each nozzle heater is set based upon the current sample.

20 Claims, 3 Drawing Sheets

ELECTRONIC CONTROL FOR CONSISTENT INK JET IMAGES

BACKGROUND AND SUMMARY OF THE INVENTION

It has been observed for many years that ink jet devices (typically ink jet printers) vary in the density of the image produced. It has been proposed that the image density be changed so that it is substantially uniform by changing the dot size and/or by varying the location of dots printed on the paper by ink jet cartridges having a plurality of nozzles. Regardless of whether the image variation is due to operation of the cartridge or the absorbency of the paper, it is known that by varying the voltage pulse energy applied to electrical resistance heaters in a print cartridge the volume of the dot of ink issuing from the nozzle associated with that electrical resistance heater can vary. It has been proposed to make more uniform density by optically sensing the line width printed by the nozzles of the cartridge, determining the predetermined optimum line width compared to the optically sensed printed line width, and then electronically controlling the voltage pulse applied to an electrical resistance heater associated with an ink jet nozzle to thereby increase or decrease the volume of the ink dot issuing therefrom, so as to provide more uniform density. While such a proposal can theoretically solve the problem of undesirably varying density (particularly associated with different ink jet nozzles from the same cartridge), the procedure is relatively complex and requires an optical sensor which may not be a particularly desirable component in an ink jet printer environment.

According to the present invention it has been recognized that ink jet devices that image lightly draw less electrical current than those that image darkly. Therefore, according to the invention the ability to sense this current draw for a fixed pattern and to compensate for different current draws allows adjustment for consistent imaging from all ink jet devices in an array (such as a plurality of nozzles in a cartridge, or a plurality of cartridges in an array of cartridges). Taking advantage of this knowledge that lightly imaging ink jet devices draw electrical current, within the permissible operating range the voltage of pulse width supplied to the electric resistance heating elements of the device can be adjusted to thereby vary the image density, the electric resistance heater typically varying the volume of the ink drops issuing from the device. The invention is applicable to a single ink jet device so that the image density thereof is properly controlled, or it may be utilized with a plurality of ink jet devices to sense the individual energy consumed and to adjust the voltage or pulse width supplied thereto to thereby provide more consistent imaging.

According to one aspect of the present invention a method of varying the image density of the ink from an ink jet device having an electrical heater (typically an electric resistance heater) is provided. The method comprises the steps of electronically and automatically: (a) automatically measuring the electrical power consumption of the ink jet device; and (b) in response to step (a), if necessary automatically adjusting the pulse width or voltage supplied to the heater of the ink jet device by supplying more electrical power if greater image density is desired, and less electrical power if lower image density is desired.

Where a plurality of ink jet devices are provided, each having an electrical heater, step (a) is practiced to measure the electrical power consumption of each of the ink jet devices and step (b) is practiced to control the pulse width or voltage to each of the ink jet devices so that the image density of each of the ink jet devices is controlled as desired. Step (b) is typically practiced to make the image densities of the ink jet devices substantially uniform.

Step (a) is typically practiced by measuring the current consumed by the heater of the ink jet device and more desirably by sampling the current consumed, especially where a plurality of the ink jet devices are to be controlled simultaneously. Steps (a) and (b) typically may be practiced to reset all pulse widths to default settings, then to determine if a calibrate signal was received, then to signal the pattern generator to provide test data, then to sample present peak current consumed by each print ink jet device, and then to set the pulse width for each ink jet device based upon the current sample.

According to another aspect of the present invention an ink jet printing assembly is provided comprising the following components: An ink jet device having an electrical heater (e.g. an electric resistance heater) and a nozzle from which ink issues. Means for automatically electronically measuring the electrical power consumed by the ink jet device. And means responsive to the measuring means for automatically controlling the pulse width or voltage supplied to the heater to thereby control the image density of ink issuing from the nozzle. The measuring means preferably comprises means for measuring the electrical current consumed by the heater of the ink jet device. For example, it may comprise electronic circuitry including a gain circuit, a low pass filter, a peak detection and hold circuit, an analog to digital converter, and a microprocessor. The ink jet device may comprise a cartridge containing a plurality of heaters and a plurality of nozzles, and the measuring means and controlling means may be connected to each of the heaters and nozzles.

According to yet another aspect of the present invention an ink jet printing assembly is provided comprising the following components: A plurality of ink jet devices, each having an electrical heater, and a nozzle from which ink issues. Means for automatically electronically measuring the electrical power consumed by each of the ink jet devices. And means responsive to the measuring means for automatically controlling the pulse width or voltage supplied to the heaters of the devices to thereby control the image density of ink issuing from the nozzles of the devices to make the image density from the devices substantially uniform.

The measuring means preferably comprises means for sampling and measuring the electrical current consumed by the heaters of the ink jet devices. The measuring means may comprise electronic circuitry such as described above. Each of the ink jet devices may comprise a cartridge containing a plurality of heaters and a plurality of nozzles, the measuring means and controlling means connected to each of the heaters and nozzles, or the ink jet devices may comprise a plurality of nozzles with associated heaters in the same cartridge.

It is a primary object of the present invention to accurately and practically provide control over image density from an ink jet device, and to provide substantially uniform density for a plurality of different devices. This and other objects of the invention will become clear from an inspection of the detailed description of the invention, and from the appended claims.

DETAILED DESCRIPTION OF THE DRAWINGS

Figure 1:
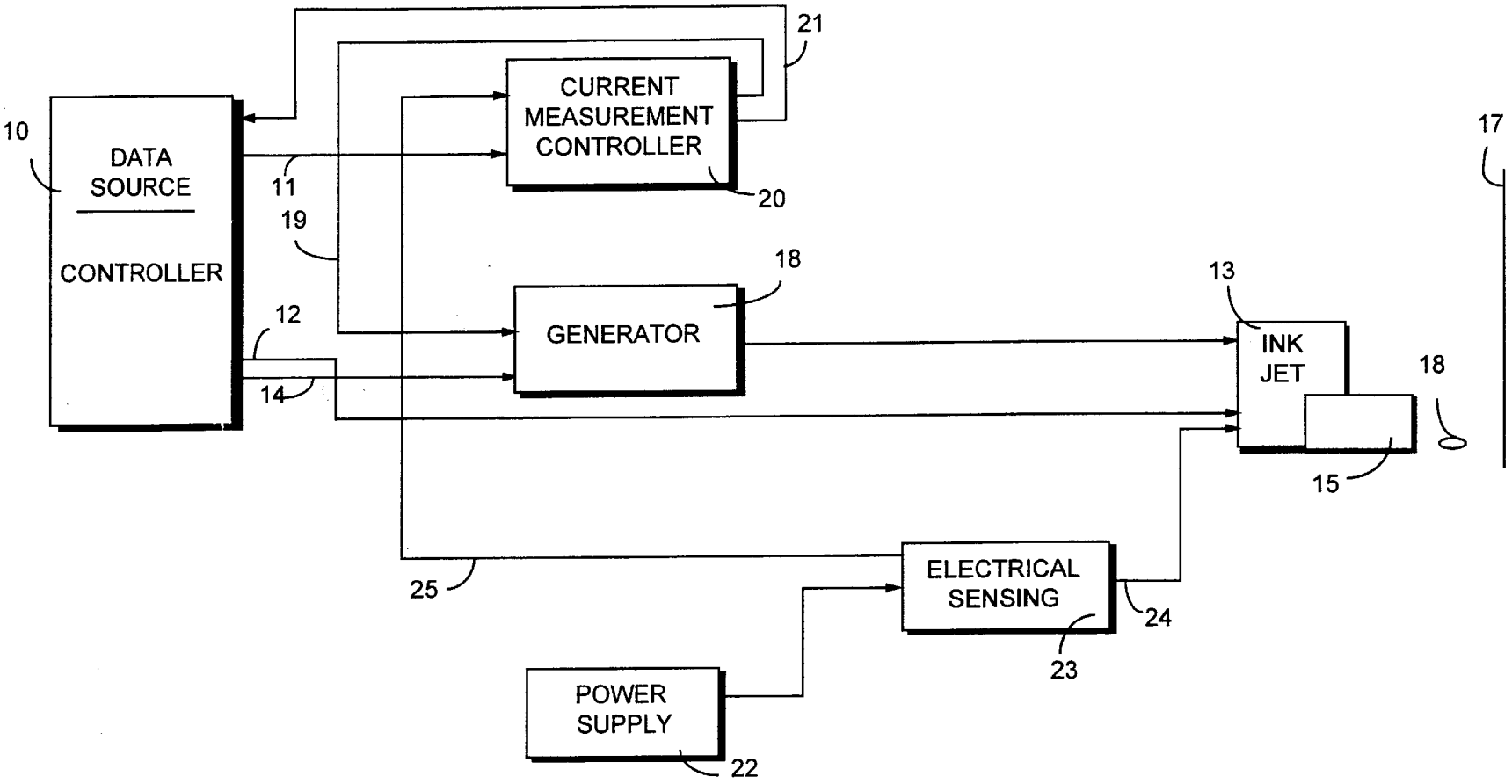
FIG. 1 is a block diagram of an ink jet system according to the present invention using print device current consumption to compensate for image density variations.

FIG. 1 provides a block diagram of an ink jet printing assembly according to the present invention which utilizes device current consumption to compensate for image density variations. Box 10 in FIG. 1 schematically illustrates a print data source and print device controller which is conventional and typically includes a microprocessor. Issuing from the device 10 is a calibrate signal 11, cartridge control signals 12 which typically control each of the electrical resistance heaters in a cartridge or other ink jet printing device, seen schematically at 13 in FIG. 1, and a print data signal 14. The cartridge control signal line 12 is, as seen in FIG. 1 and earlier indicated, connected directly to the electric resistance heater of the ink jet printing device 13. Where the device 13 is a conventional cartridge, it typically includes a plurality of orifices—shown schematically at 15 in FIG. 1, from which ink droplets 16 of various volumes issue to impact a substrate on which imaging is to be practiced, such as a piece of paper 17. The print data signal line 14 is connected up to a measurement pattern generator 18, which also receives an input 19 from an ink jet device current measurement controller 20, the line 19 providing an enable pattern signal to the generator 18. The current measurement controller 20 also has a pulse width data output 21 leading back to the data source and master controller 10.

Imaging power is provided to the device 13 from a power supply 22 (e.g. a +24 volt DC supply) through electrical current sensing means 23 to the ink jet printing device 13. Imaging power is supplied from electrical current sensing means 23 through line 24 to the device 13, and the measured current signal is provided by feedback line 25 back to the printing device current measurement controller 20. That is, the structures 10, 18 and 20, and/or associated software, comprise exemplary means responsive to the measuring means 23 for automatically controlling the pulse width or voltage supplied to the heaters associated with the nozzles 15 of device 13 to thereby control the image density of ink issuing from each of the nozzles 15.

Figure 2:
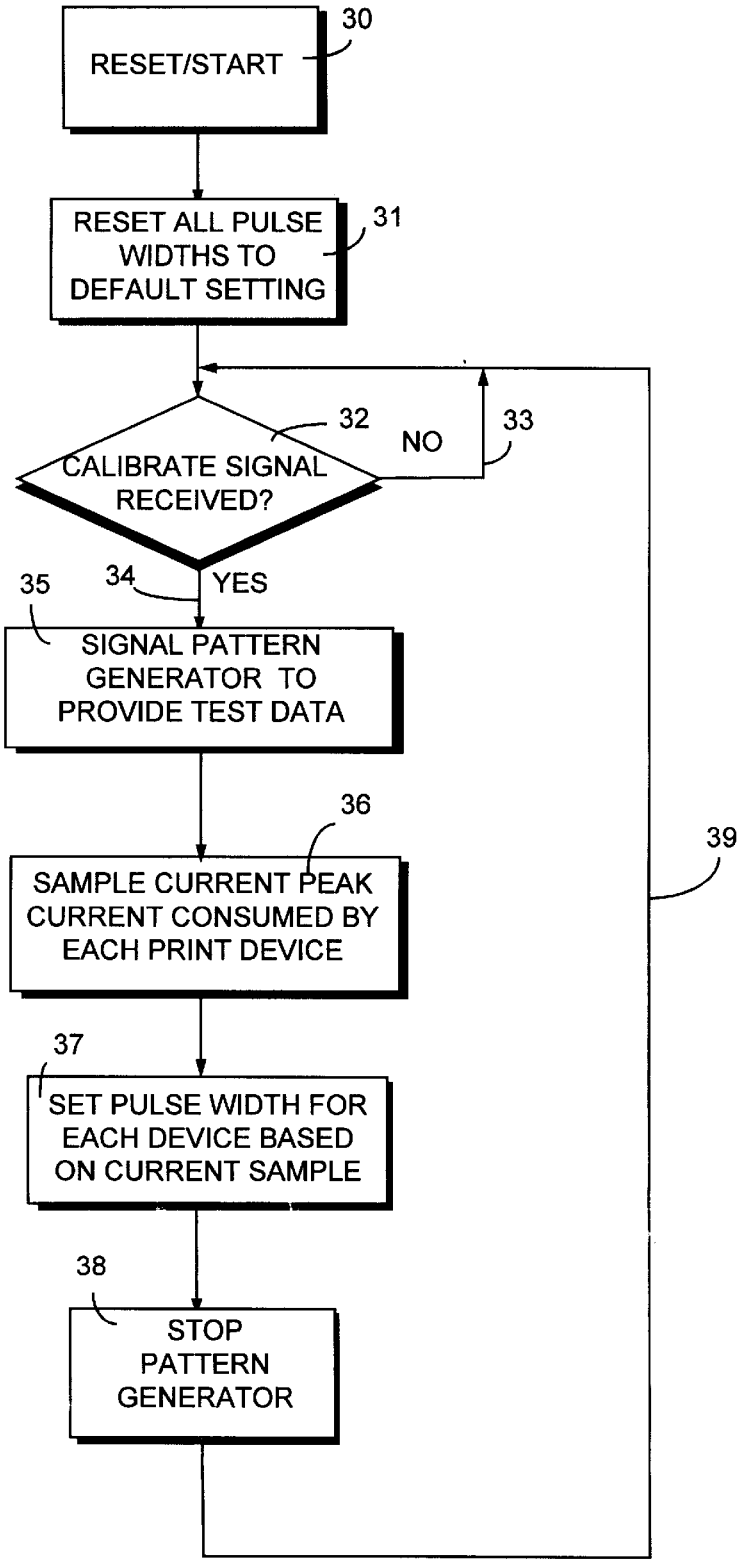
FIG. 2 is a high level flow sheet showing ink jet cartridge pulse width compensation that may be practiced according to the present invention.

FIG. 2 schematically illustrates a high level flow sheet format for an exemplary control procedure practiced according to the present invention. From reset/start block 30 control passes to block 31 which provides for the reset of all pulse widths—such as associated with individual heaters of individual orifices of an ink jet cartridge 13—to default setting. Control then passes to decision block 32 which asks if the calibrate signal (line 11 in FIG. 1) is received from the master controller 10. If the answer is NO, control loops back to the decision block 32 as indicated by line 33. If the answer is YES, control passes, as indicated by line 34, to control block 35 which operates to signal the pattern generator 18 to provide test (sampling) data. The present peak electrical current consumed by each print device is sampled as indicated at block 36 in FIG. 2 utilizing device 23 from FIG. 1 including the feedback in line 25 to current measurement controller 20, and then the pulse width is set for each device based on the current sample, as illustrated by block 37, and as represented by the output line 21 from controller 20 leading back to the main controller 10, which then provides appropriate control signals in lines 12 and 14. The pattern generator is then stopped as indicated at block 38 in FIG. 2, and then control passes in line 39 back to the input to the decision block 32.

Figure 3:
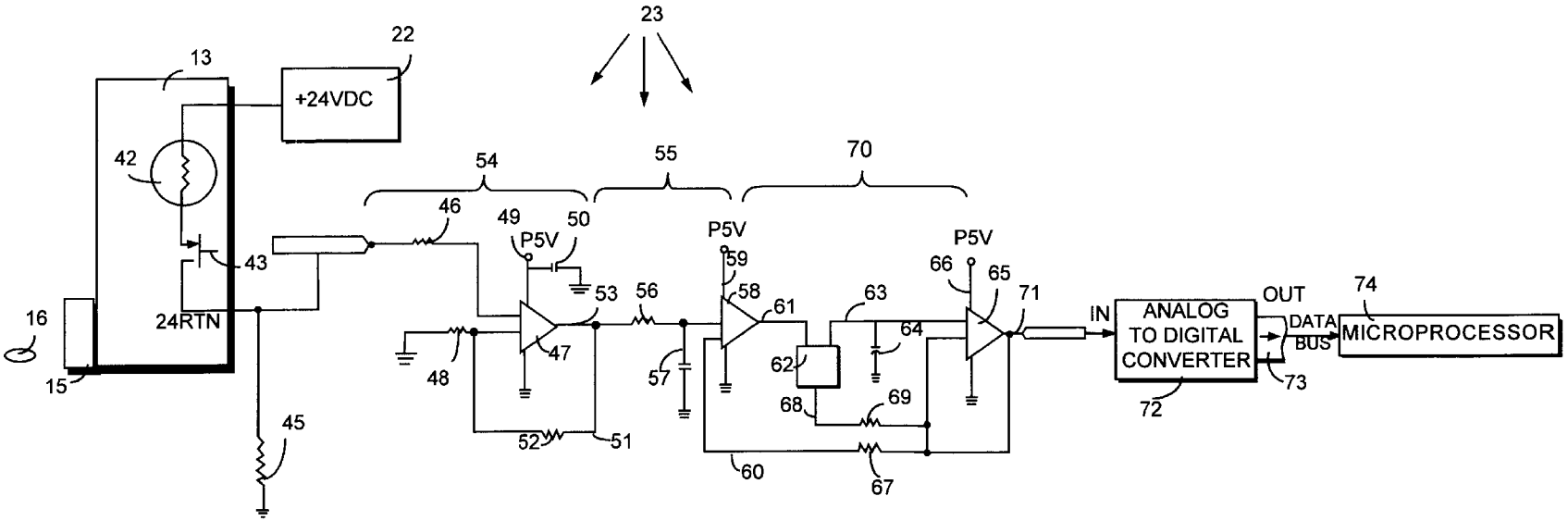
FIG. 3 is a schematic circuit diagram illustrating exemplary current sensing and related control circuitry according to the present invention.

While the particular electrical power consumption (e.g. current) measuring means 23 utilized according to the present invention may be any one of a wide variety of conventional devices for measuring various indicators of power consumption, including conventional current consumption indicators or like current measuring devices, a particularly suitable device is illustrated in the exemplary embodiment of FIG. 3, the electronic circuitry therein being shown schematically at 23 in association with an ink jet device (e.g. for a 128 pixel print cartridge) 13 having an electrical heater, such as an electric resistance heater 42, a control switch 43, and an orifice 15 for each pixel. The control switch 43 is controlled by controller 10 and generator 18.

The first element of the means 23 illustrated in FIG. 3 is a ground current sensing resistor 45 (e.g. a 0.5 ohm resistor). The resistor 45 is connected through another resistor 46 (e.g. a 1 ohm resistor) to pins 2 and 3 of a op-amp 47 as an input. Pin 2 of the op-amp 47 is connected through a resistor 48 (e.g. a 1 ohm resistor) to ground, pin 1 is connected directly to ground, and pin 4 is provided with power from a 5 volt line 49 which in turn is connected through a capacitor (e.g. a 0.001 microfarad capacitor) to ground. A line 51 having a resistor 52 (e.g. 8.2 ohm) therein is connected between resistor 48 and the output line 53 from pin 7 of op-amp 47. The op-amp 47 and associated circuitry provide a gain circuit element 54.

Provided in connection with line 53 and serving as a low pass filter element 55 is a resistor 56 (e.g. 22 ohm) and a capacitor 57 (e.g. 0.001 microfarad), the capacitor 57 connected to ground. The line 53 on the opposite side of resistor 56 from op-amp 47 is connected to input pin 5 of a second op-amp 58. Pin 4 of op-amp 58 is provided with current from a 5 volt source as indicated by line 59. Pin 1 of op-amp 58 is connected to ground, pin 6 to line 60, and an output line 61 extends from pin 7 of op-amp 58.

Line 61 is connected to pin 1 of an integrated circuit 62 such as an ML3D1203. Pin 2 of the integrated circuit 62 is connected by line 63 to ground through capacitor 64 (e.g. a 0.47 microfarad capacitor) and to pin 10 of the op-amp 65, also provided with a 5 volt power source at pin 4 as indicated by line 66. Pin 11 of the op-amp 65 is connected to ground, pin 9 is connected to line 60 through resistor 67 (e.g. a 20 ohm resistor) and to pin 3 of integrated circuit 62 through line 68 and resistor 69 (e.g. a 470 ohm resistor). The component 58, 62, 65, etc. comprise a peak detection and hold circuit 70. The operational amplifiers—op-amp 47, 58 and 65 are typically part of the same chip, such as an NAX475 SMD.

Line 71, connected to both the op-amp 65 and line 60, is also connected to analog to digital converter 72, which in turn is connected by a data bus 73 to a microprocessor 74, provided in controller 20, or associated with control 20 and provided in main controller 10.

The electronic circuitry 23 illustrated in FIG. 3 is connected, utilizing sampling techniques, to each of the one pixel heaters 42 of the cartridge 13 to provide sufficient information to effect control of the volume of the ink droplets 16 issuing from the orifice 15 associated with the heater 42, to thereby control the image density from that orifice 15. Utilizing the sampling technique control is easily effected for all of the orifices 15 associated with an ink jet cartridge 13 or like device, and also with a number of cartridges in an array. The controller 10 and the generator 18 control the ink jet devices 13 so that the image densities are substantially uniform (in the preferred embodiment, although if for some unusual situation a particular variance of image density that is desired that can be accomplished also). Control is effected by automatically adjusting the pulse width or voltage supplied to the heaters 42, supplying more electrical power from power supply 22 if greater image density is desired (larger drop 16 volumes) and less power if lower image density is desired (lower volume drops 16).

It will thus be seen that according to the present invention the electrical power consumption of the ink jet device 13 (e.g. a particular heater 42 therein) is measured (typically by measuring the electrical current draw), and then in response thereto, if necessary, the pulse width or voltage supplied to the heater 42 is automatically adjusted. These steps are typically practiced, as schematically illustrated in FIG. 2, to reset all pulse widths to default setting (31), and then to determine if a calibrate signal was received (32, 11), then to signal the pattern generator 18 (35) to provide test data, then to sample the peak current consumed by each ink jet device (heater 42, using the means 23, as indicated at 36), and then to set the pulse width (37) for each ink jet device 13 based upon the current sample.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A method of varying the image density of an ink image formed by ink from an ink jet device having an electrical heater, comprising the steps of electronically and automatically:

(a) automatically measuring the electrical power consumption of the ink jet device; and (b) depending on the power consumption measured in step (a), automatically adjusting the pulse width or voltage supplied to the heater of the ink jet device by supplying more electrical power if greater image density is desired, and less electrical power if lower image density is desired.

2. A method as recited in claim 1 wherein a plurality of ink jet devices, each having an electrical heater, are provided; and wherein step (a) is practiced to measure the electrical power consumption of each of the ink jet devices, and step (b) is practiced to control the pulse width or voltage to each of said ink jet devices so that the image density of images formed by ink issuing from each of the ink jet devices is controlled as desired.

3. A method as recited in claim 2 wherein step (b) is practiced to make the image density of images formed by ink issuing from each of the ink jet devices substantially uniform.

4. A method as recited in claim 1 wherein step (a) is practiced by measuring the current consumed by the heater of the ink jet device.

5. A method as recited in claim 4 wherein step (a) is practiced to sample the current consumed.

6. A method as recited in claim 2 wherein step (a) is practiced to sample the current consumed.

7. A method as recited in claim 3 wherein step (a) is practiced to sample the current consumed.

8. A method as recited in claim 2 wherein steps (a) and (b) are practiced by resetting all pulse widths to default settings, then determining if a calibrate signal was received, then signalling a pattern generator to provide test data, then sampling present peak current consumed by each print ink jet device, and then setting the pulse width for each ink jet device based upon the current sample.

9. A method as recited in claim 3 wherein steps (a) and (b) are practiced by resetting all pulse widths to default settings, then determining if a calibrate signal was received, then signalling a pattern generator to provide test data, then sampling present peak current consumed by each print ink jet device, and then setting the pulse width for each ink jet device based upon the current sample.

10. An ink jet printing assembly comprising:

an ink jet device having an electrical heater and a nozzle from which ink issues;

means for automatically electronically measuring the electrical power consumed by said ink jet device; and means responsive to said measuring means for automatically controlling the pulse width or voltage supplied to said heater to thereby control the image density of an ink image formed by ink issuing from said nozzle.

11. An assembly as recited in claim 10 wherein said measuring means comprises means for measuring the electrical current consumed by said heater of said ink jet device.

12. An assembly as recited in claim 11 wherein said measuring means comprises a gain circuit, a low pass filter, a peak detection and hold circuit, an analog to digital converter, and a microprocessor.

13. An assembly as recited in claim 10 wherein said ink jet device comprises a cartridge containing a plurality of heaters and a plurality of nozzles, said measuring means and said controlling means connected to each of said heaters.

14. An assembly as recited in claim 10 wherein said ink jet device comprises a cartridge containing a plurality of heaters and a plurality of nozzles, said measuring means and said controlling means connected to each of said heaters.

15. An ink jet printing assembly comprising:

a plurality of ink devices, each having an electrical heater, and a nozzle from which ink issues;

means for automatically electronically measuring the electrical power consumed by each of said ink jet devices; and means responsive to said measuring means for automatically controlling the pulse width or voltage supplied to said heaters of said devices to thereby control the image density of ink issuing from said nozzles of said devices to make the image density of an ink image formed by ink issuing from each of the devices substantially uniform.

16. An assembly as recited in claim 15 wherein said measuring means comprises means for sampling and measuring the electrical current consumed by said heaters of said ink jet devices.

17. An assembly as recited in claim 16 wherein said measuring means comprises a gain circuit, a low pass filter, a peak detection and hold circuit, an analog to digital converter, and a microprocessor.

18. An assembly as recited in claim 17 wherein each of said ink jet devices comprises a cartridge containing a plurality of electric resistance heaters and a plurality of nozzles, said measuring means and said controlling means connected to each of said heaters.

19. An assembly as recited in claim 15 wherein each of said ink jet devices comprises a cartridge containing a plurality of electric resistance heaters and a plurality of nozzles, said measuring means and said controlling means connected to each of said heaters.

20. An assembly as recited in claim 15 wherein said ink jet devices comprise a plurality of nozzles each having its own electric resistance heater, in the same cartridge; said measuring means and said controlling means connected to each of said heaters.

* * * * *